United States Patent [19]

Kirk

[11] 3,980,139

[45] Sept. 14, 1976

[54] FIRE EXTINGUISHING BOMB FOR PUTTING OUT FIRES

[76] Inventor: Norman Kirk, 9 Rosedale Ave., Montclair, N.J. 07042

[22] Filed: Sept. 15, 1975

[21] Appl. No.: 613,188

[52] U.S. Cl. ..... 169/28; 102/64; 169/36

[51] Int. Cl.[2] ..... A62C 19/00

[58] Field of Search ..... 169/28, 36; 102/64

[56] References Cited

UNITED STATES PATENTS

| | | | |
|---|---|---|---|
| 299,318 | 5/1884 | Atterbury | 169/36 |
| 655,599 | 8/1900 | Braunwalder | 169/36 |
| 2,665,768 | 1/1954 | Talbot | 169/36 |
| 3,340,810 | 9/1967 | Di Paola | 102/64 |

FOREIGN PATENTS OR APPLICATIONS

| | | | |
|---|---|---|---|
| 1,311,601 | 10/1962 | France | 169/36 |

*Primary Examiner*—Evon C. Blunk
*Assistant Examiner*—Michael Mar
*Attorney, Agent, or Firm*—Richard L. Miller

[57] ABSTRACT

A bomb containing an explosive and a fire extinguishing chemical so that the bomb can be exploded within a fire and extinguish the fire flames; the bomb including a glass cylinder that can be readily fragmented so to disperse its chemical content into all directions and the glass cylinder having extending fins so to absorb a rising temperature such as from a vicinity fire, the fins transfering the heat to an explosive charge for automatic operation.

3 Claims, 3 Drawing Figures

FIRE EXTINGUISHING BOMB FOR PUTTING OUT FIRES

This invention relates generally to fire extinguishing appliances.

A principal object of the present invention is to provide a fire extinguishing device of portable type which can thus be easily placed into areas that are subject to catching upon fire, and which will automatically be activated by heat from fire flames so to extinguish the same.

Another object is to provide a fire extinguishing device which otherwise can be brought to an existing fire and then be hurled into a center thereof so to put out the fire at its center thus differing from other types of fire extinguishers which can attack a fire only along its peripheral edges.

Yet another object is to provide a fire extinguishing device that can be readily installed anywhere within a building, ship or other area so to automatically protect the same from fire destruction, and which by being completely self contained without need of any electrical or other connections to other objects, thus eliminates the elaborate installations of water pipes, or electric circuit systems for guarding areas from a fire.

Yet a further object is to provide a fire extinguishing device of bomb type so that it can instantly scatter its effective fire extinguishing chemical over a large area.

Other objects are to provide a fire extinguishing bomb which is simple in design, inexpensive to manufacture, rugged in construction, easy to use and efficient in operation.

Further objects of the invention will appear as the description proceeds.

To the accomplishment of the above and related objects this invention may be embodied in the form illustrated in the accompanying drawings, attention being called to the fact, however, that the drawings are illustrative only, and that changes may be made in the specific construction illustrated and described within the scope of the appended claims.

Figure 1:
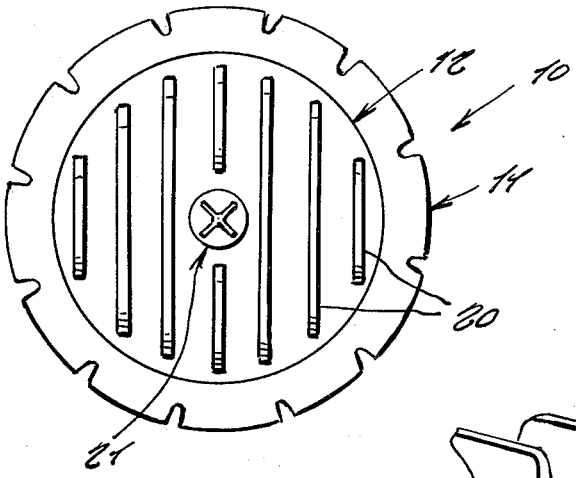
FIG. 1 is a top view of the present invention.
Figure 3:
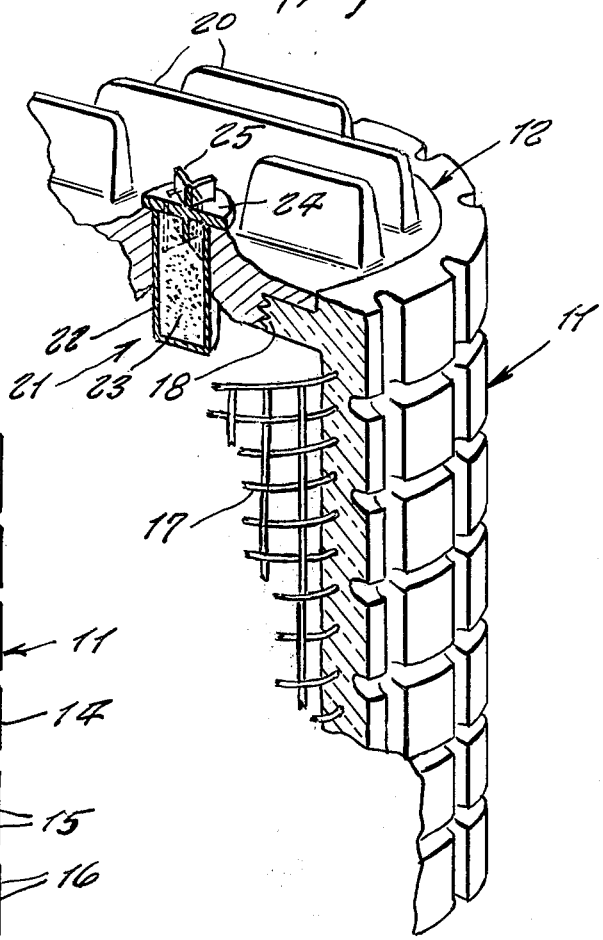
FIG. 3 is a fragmentary perspective view thereof showing its internal construction.
Figure 2:
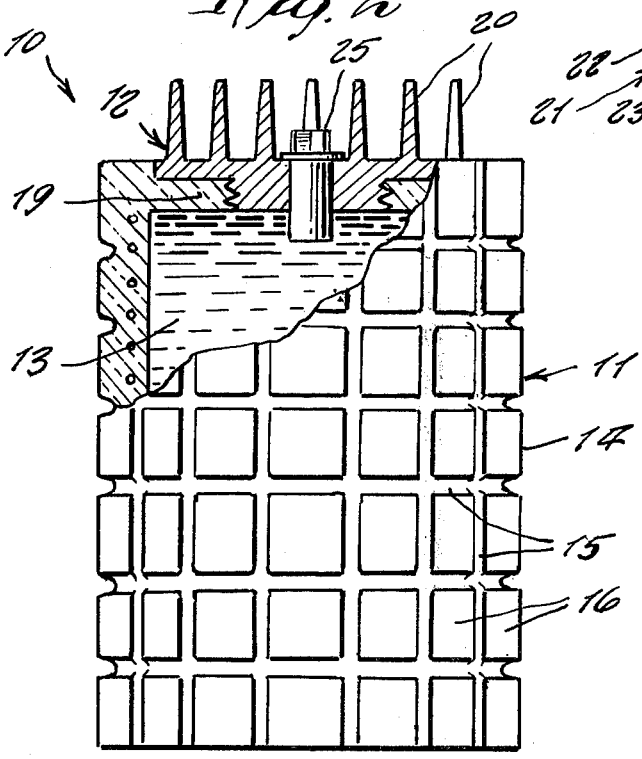
FIG. 2 is a side view thereof shown partly in cross section.

Referring now to the drawing in detail, the reference numeral 10 represents a fire extinguishing bomb according to the present invention wherein the same includes a cylindrical container 11 made of molded glass and a removable screw cap 12 made of metal for closing a top opening after filling the container with a chemical 13 having characteristics for smothering a fire.

The cylindrical side wall 14 of the container has vertical and annular grooves 15 formed in its outer side which cross each other so to form rectangular, raised pads 16 therebetween. Within the interior of the side wall 14 is imbedded a metal screen 17 around which the glass container is molded. A threaded opening 18 in a top wall 19 of the container receives the cap.

The cap 12 includes a plurality of parallel, upward fins 20 surrounding a central firing pin 21 that extends through a center of the cap so that its upper end is exposed to the atmosphere and its lower end contacts the chemical 13. The pin 21 consists of a thin metal shell 22 containing an explosive charge 23; the upper wall 24 having a cross shaped fin 25 projecting upwardly above the wall 24 and also downwardly into the shell interior. As shown, it is to be noted that the blader of the fin 25 are along planes at 45 degrees respective to the plane of fins 20 so to more effectively absorb thermal changes from the fins 20.

It is now readily evident that in case a fire occurs in the vicinity of the bomb 10 that the fins will get hot most quickly and transfer the hot temperature to fin 25 which projects into the explosive charge 23 which when effected by a raised temperature explodes, thus bursting the glass container 11 and disperse the chemical 13 in all directions which thus smothers the fire. The chemical may be of a type that instantly absorbs a large quantity of oxygen so that the flames are immediately starved. The metal screen tends not to break up during the explosion as the force passes through the screen openings, so the screen serves to tend and keep the broken glass fragments to hold thereto thus preventing excessive scattering of the glass fragments.

As indicated, the bomb can be easily simply placed within any area that is intended to be protected against a fire occuring. Alternately, it can be used for hurling into the center of an existing fire so to put out the fire from its center.

Thus a fire fighting bomb is provided.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. In a Fire Extinguishing Bomb, the combination of a fracturable glass container having a filling opening on top, a metal cap screwed in said opening, an interior of said container being filled with a chemical having properties to put out a fire, and said cap having an explosive fire pin through its center and which explodes at a high temperature, wherein said container includes a side wall having its outer side formed with a plurality of crossing vertical and horizontal grooves so to form pads therebetween, and a metal screen is imbedded in said side wall.

2. The combination as set forth in claim 1 wherein said cap includes a plurality of parallel outward extending fins surrounding said fire pin.

3. The combination as set forth in claim 2, wherein said fire pin comprises a shell containing an explosive charge, said shell including a fin extending through its outer wall.

* * * * *